US006448750B1

(12) United States Patent
Shor et al.

(10) Patent No.: US 6,448,750 B1
(45) Date of Patent: Sep. 10, 2002

(54) VOLTAGE REGULATOR FOR NON-VOLATILE MEMORY WITH LARGE POWER SUPPLY REJECTION RATION AND MINIMAL CURRENT DRAIN

(75) Inventors: Joseph Shor, Tel Mond; Yair Sofer, Tel Aviv; Eduardo Maayan, Kfar Saba, all of (IL)

(73) Assignee: Saifun Semiconductor Ltd., Netanya (IL)

( * ) Notice: Subject to any disclaimer, the term of this patent is extended or adjusted under 35 U.S.C. 154(b) by 0 days.

(21) Appl. No.: 09/827,755

(22) Filed: Apr. 5, 2001

(51) Int. Cl.[7] ..... G05F 1/40
(52) U.S. Cl. ..... 323/282
(58) Field of Search ..... 323/265, 266, 323/268, 271, 273, 280, 282, 285, 312, 315, 316

(56) References Cited

U.S. PATENT DOCUMENTS

| | | | |
|---|---|---|---|
| 4,173,766 | A | 11/1979 | Hayes |
| 4,586,163 | A | 4/1986 | Koike |
| 4,742,491 | A | 5/1988 | Liang et al. |
| 4,916,671 | A | 4/1990 | Ichiguchi |
| 5,168,334 | A | 12/1992 | Mitchell et al. |
| 5,172,338 | A | 12/1992 | Mehrotra et al. |
| 5,276,646 | A | 1/1994 | Kim et al. |

(List continued on next page.)

FOREIGN PATENT DOCUMENTS

GB 2157489 10/1985

OTHER PUBLICATIONS

J.D. Bude et al., "EEPROM/Flash Sub 3.0 V Drain–Source Bias Hot carrier Writing", *IEDM* 95, pp. 989–992.

J.D. Bude et al., "Secondary Electron Flash –a High Performance, Low Power Flash Technology for 0.35 um and Below", *IEDM* 97, pp. 279–282.

J.D . Bude and M.R. Pinto, "Modeling Nonequilibrium Hot Carrier Device Effects", *Conference of Insulator Specialists of Europe, Sweden*, Jun. 1997.

*Primary Examiner*—Matthew Nguyen
(74) *Attorney, Agent, or Firm*—Eitan, Pearl, Latzer & Cohen-Zedek

(57) ABSTRACT

A regulator circuit to deliver a regulated boosted voltage VPP from a charge pump to electrodes of the cells of a non-volatile memory (NVM) array, such as an EPROM, integrated circuit device. The regulator includes a differential amplifier operating from a VDD voltage lower than VPP that drives a gain stage whose output is to a current mirror operating from the boosted VPP voltage. The current mirror output is taken across a voltage divider as the regulated output of the circuit. The differential amplifier has one input at a fixed voltage and the other being a feedback voltage from the voltage divider to control the gain of the differential amplifier and thereby regulate the output of the gain stage and current mirror in response to a variable load current of the integrated circuit device. The circuit is capable of providing current at the boosted VPP voltage for programming the cells of the NVM while minimizing power consumption from the VDD supply of the charge pump and having a high PSRR (power supply rejection ratio) as compared to prior art circuits.

13 Claims, 5 Drawing Sheets

U.S. PATENT DOCUMENTS 5,280,420 A 1/1994 Rapp
5,338,954 A 8/1994 Shimoji
5,349,221 A 9/1994 Shimoji
5,467,308 A 11/1995 Chang et al.
5,553,030 A 9/1996 Tedrow et al.
5,559,687 A 9/1996 Nicollini et al.
5,568,085 A 10/1996 Eitan et al.
5,672,959 A * 9/1997 Der ..... 323/273
5,717,581 A 2/1998 Canclini
5,726,946 A 3/1998 Yamagata et al.
5,768,192 A 6/1998 Eitan
5,812,456 A 9/1998 Hull et al.
5,825,686 A 10/1998 Schmitt-Landsiedel et al.
5,946,258 A 8/1999 Evertt et al.
5,949,728 A 9/1999 Liu et al.
6,011,725 A 1/2000 Eitan
6,064,251 A 5/2000 Mukainakano et al.
6,163,048 A 12/2000 Hirose et al.
6,188,211 B1 * 2/2001 Rincon-Mora et al. ..... 323/280
6,201,282 B1 3/2001 Eitan
6,246,555 B1 * 6/2001 Tham ..... 361/18

* cited by examiner

VOLTAGE REGULATOR FOR NON-VOLATILE MEMORY WITH LARGE POWER SUPPLY REJECTION RATION AND MINIMAL CURRENT DRAIN

FIELD OF THE INVENTION

This invention relates to voltage regulators for use in the current supply to the drain on other electrodes of the memory transistors of a non-volatile memory integrated circuit.

BACKGROUND OF THE INVENTION

In using non-volatile memory (NVM) arrays, such as EPROMs, a relatively large current is required to be delivered to the drain electrodes of the transistor memory cells. This is usually done at a boosted voltage, called VPP (typically 4–7V), which is above the standard voltage supply, called VDD (typically 1.8–3.6V). The source of the boosted voltage is usually a charge-pump. A typical charge pump for a NVM array is shown for example, in U.S. Pat. No. 5,280,420. Typically, the boosted output voltage VPP of the pump has an AC ripple which is superimposed on the DC level. In many instances, a voltage regulator is used between the output of the charge pump and the NVM to eliminate AC ripple and fix the DC voltage irrespective of process/environment variations.

It is important that such a regulator has a high power supply rejection ratio (designated PSRR) so that the charge pump noise or ripple does not reach the NVM transistors, such as the drain electrodes of EPROM transistor memory cells, and affect the programming or erase characteristics of the memory cells. In addition, as the efficiency of the charge pump is typically 30%, it is important for the regulator to minimize the current consumption on the charge pump in order to conserve power.

A prior art regulator, which minimizes current consumption on the charge pump, is shown in FIG. 1. In this regulator there is a differential amplifier gain stage, GM1, and an inverting amplifier gain stage, GM2. Both GM1 and GM2 receive as operating voltage the voltage VPP from the charge pump supply (not shown). Gain stage GM1 is basically a differential amplifier whose inverted input is from a stable reference bias voltage source IP. The output of GM1 is applied to the gate of GM2, which is shown as a P-channel MOS transistor (PMOS).

The boosted voltage VPP from the charge pump is applied to GM1 as its operating voltage and is also applied to the source of GM2. The drain of GM2 is connected to the reference potential (ground) through a voltage divider of two series connected resistors R1 and R2. A capacitor (Cm), commonly called the "Miller capacitor", is connected to the gate of GM2 and the output of GM1 at n1 and to the upper end of the voltage divider R1 and R2 at n2. The capacitor Cm is used to stabilize the operation of GM1. A capacitor CL is across the voltage divider R1-R2 to ground.

The load current, $I_{LOAD}$, which is the current drawn by the memory cells of the NVM, is taken off at the drain of GM2 at node n2, across the two resistors R1 and R2 to ground. The voltage output at n2 is set by the ratio of R1 and R2.

There is a feedback path fb from the junction of R1-R2 to the non-inverting input of the differential amplifier gain stage GM1. When there is a large $I_{LOAD}$, the gate of the PMOS driver GM2 adjusts itself from the feedback voltage fb to provide an appropriate current. That is, for example, as $I_{LOAD}$ increases the feedback loop sets the operation point of GM2 to drive higher current.

The circuit of FIG. 1 has a poor PSRR. This is because the Miller capacitor (Cm, used to stabilize the amplifier), couples the gate of GM2 to its drain at high frequencies. Since the load capacitor CL is coupled to ground, this means that at high frequencies the gate of GM2 effectively will be coupled to ground. When VPP is noisy at the high frequencies, the gate to source voltage (Vgs) of GM2 will change, and the noise will reach the output at n2. In general, in order to have a good PSRR, the gate electrode of GM2 must be strongly coupled to the VPP source at all frequencies so that the Vgs of GM2 remains constant.

FIG. 2 shows another prior art regulator circuit which has good PSRR but does not conserve current from the charge pump. Here, the output of a differential amplifier gain stage GM1 feeds the gate electrode of an NMOS transistor driver GM2. The drain of GM2 is connected to the output. Also connected to the output is PMOS transistor P1, which is configured as a current source to VPP, with its source node at VPP. The gate of P1 is connected to the gate of the current mirror input PMOS transistor P2 whose source also is connected to VPP. There is a stabilizing capacitor C3 for the amplifier between the output of GM1 and the drain of P1. PMOS transistor, P1, is configured as a current source for GM2. The gate of P2 is connected to its drain and the drain is DC coupled to ground by a current source shown by the intersecting circle symbol. The gate of P1 is strongly AC coupled to VPP through the transconductance characteristic (GM) of current mirror transistor P2.

Here, the differential stage GM1 inverted input receives the reference voltage IP and its output is coupled to the gate of GM2. The drain node of GM2 is connected to the drain node of P1 and the GM2 source node is connected to ground. There is a voltage divider R1-R2 having one end connected to the junction of the P1 drain node and GM2 drain node and the other end to ground. A feedback path fb is between the junction of the R1-R2 divider and the non-inverted input of GM1. A load capacitor CL is connected across R1-R2 to ground.

The PSRR of the circuit of FIG. 2 is determined by the characteristics of the current mirror P1-P2, such as its overdrive (Vgs-Vt or VDSAT) and transconductance (GM), as is known in the art. The PSRR of the circuit of FIG. 2 is relatively good because the current source to VPP (P1) has both its gate node and source node strongly AC-coupled to VPP, such that its Vgs remains relatively constant at all frequencies. The problem with the circuit of FIG. 2 is that the current in P1 must always be greater than the maximum possible current in $I_{LOAD}$. Thus, even when $I_{LOAD}$ is small, there is a significant current drain from the charge pump and VDD current is wasted.

OBJECTS OF THE INVENTION

An object of the invention is to provide a regulator for a NVM that exhibits both a high PSRR and minimal current consumption as compared to prior art regulators.

Another object of the present invention is to provide a high voltage VPP regulator having a differential stage that operates from a lower voltage VDD supply and an output stage connected to a VPP boosted supply.

An additional object is to provide a regulator to supply a boosted VPP voltage to a NVM, such as an EPROM, the regulator having an operational amplifier operating from a lower voltage VDD and receiving a feedback voltage from the load to adjust the current supply from a current mirror operating from VPP to control the load current.

BRIEF DESCRIPTION OF THE INVENTION

In accordance with the invention, a differential amplifier operating from the lower VDD voltage has one input connected to a reference bias voltage source. The amplifier output drives a gain stage that controls a current mirror operating from boosted voltage VPP, typically produced by a charge pump, and whose output is the load current that is supplied to the NVM transistor memory cells. The current mirror output flows through a voltage divider and a voltage taken from the divider is supplied as a feedback voltage to the other input of the differential amplifier. The amplifier regulates the load voltage and exhibits a good PSRR, while conserving VPP current.

BRIEF DESCRIPTION OF THE DRAWINGS

Other objects and advantages of the present invention will become more apparent upon reference to the following specification and annexed drawings, in which.

DETAILED DESCRIPTION OF THE INVENTION

Figure 3:
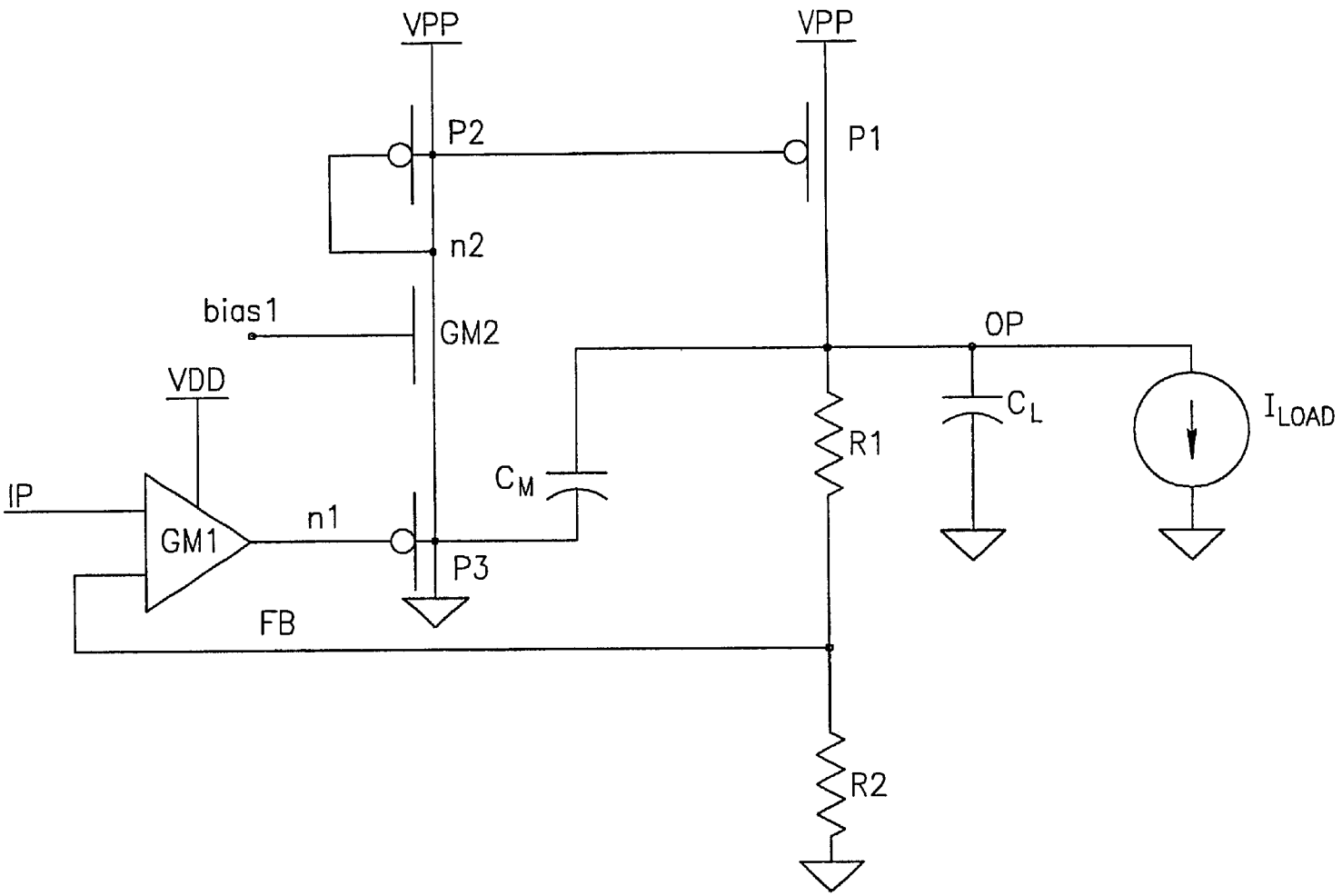
FIG. 3 is a regulator circuit in accordance with the invention.

FIG. 3 shows a regulator circuit in accordance with the invention that is capable of a high PSRR, while at the same time conserving current when $I_{LOAD}$ is low. There is a differential amplifier GM1, a first gain stage, that operates from VDD (the normal supply voltage). The VDD supply is the supply of a charge pump (not shown) which generates a boosted level voltage, VPP. GM1 does not consume any VPP current, i.e., current from the charge pump. The amplifier GM1 is an operational type amplifier and can be formed of a differential transistor pair that, as described below, drives an active current mirror load. The differential stage GM1 has two inputs. The inverting input receives a reference voltage, IP. The non-inverting input receives a feedback signal, FB, as will be explained below.

The output of GM1 drives the rate of a PMOS source follower, transistor P3. The drain of P3 is connected to ground and the output of P3 at its source node is connected to drive the source code of a second gain stage, NMOS transistor, GM2. The gate of GM2 is biased at a fixed voltage called bias 1. The details of the biasing voltage source are discussed below with reference to FIGS. 4 and 5.

The drain node of GM2 is connected at n2 to the gate and drain nodes of a PMOS transistor P2. The gate of P2 is also connected to the gate of PMOS transistor P1. The source nodes of P1 and P2 are connected to the boosted charge pump voltage, VPP. The series connected transistors P3 and GM2 determine the current in the branch of the circuit including P2. The current in the P3-GM2 branch is mirrored to P1 by P2. There can also be a multiplication factor between P2 and P1, as is well known in the art.

Figure 1:
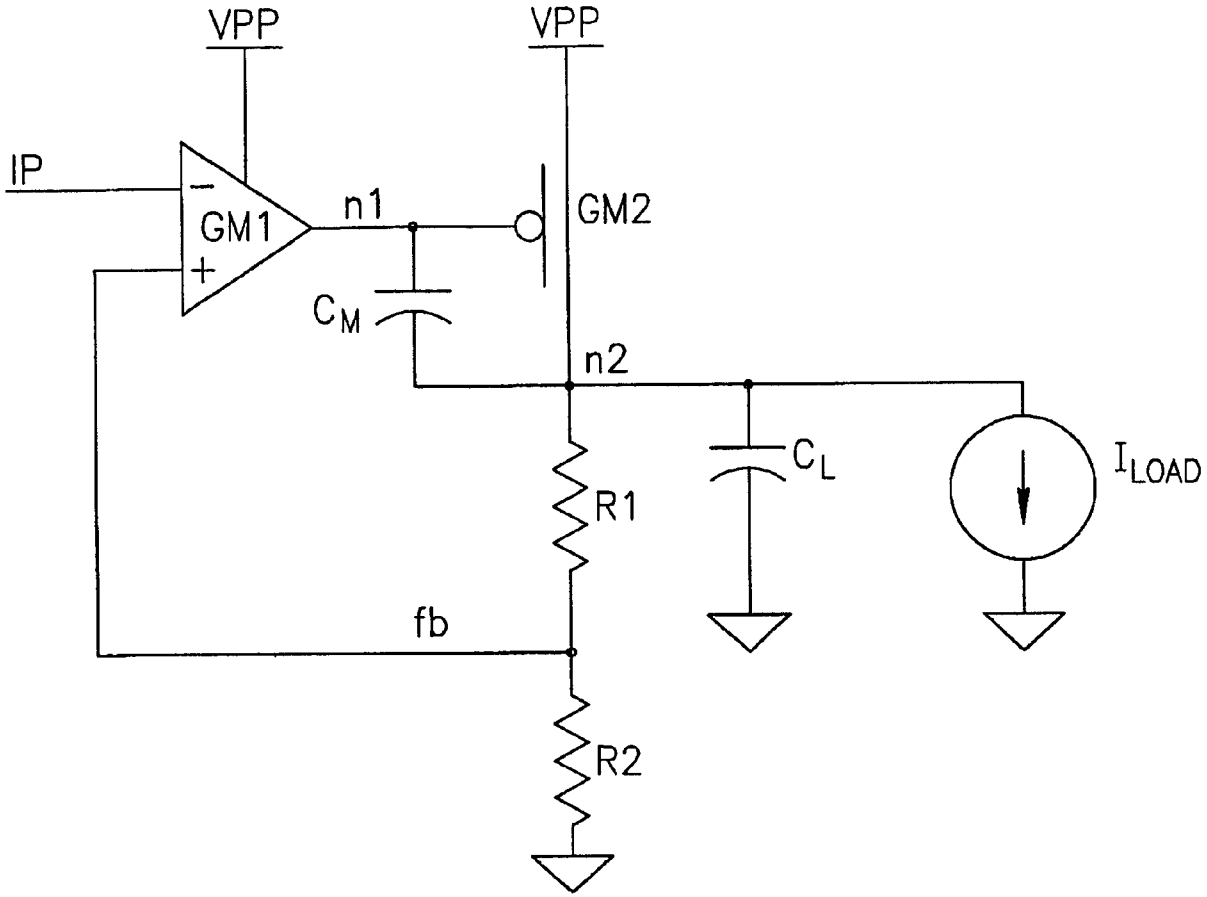
FIG.1 PRIOR ART
FIGS. 1 and 2 show prior art regulator circuits.
Figure 2:
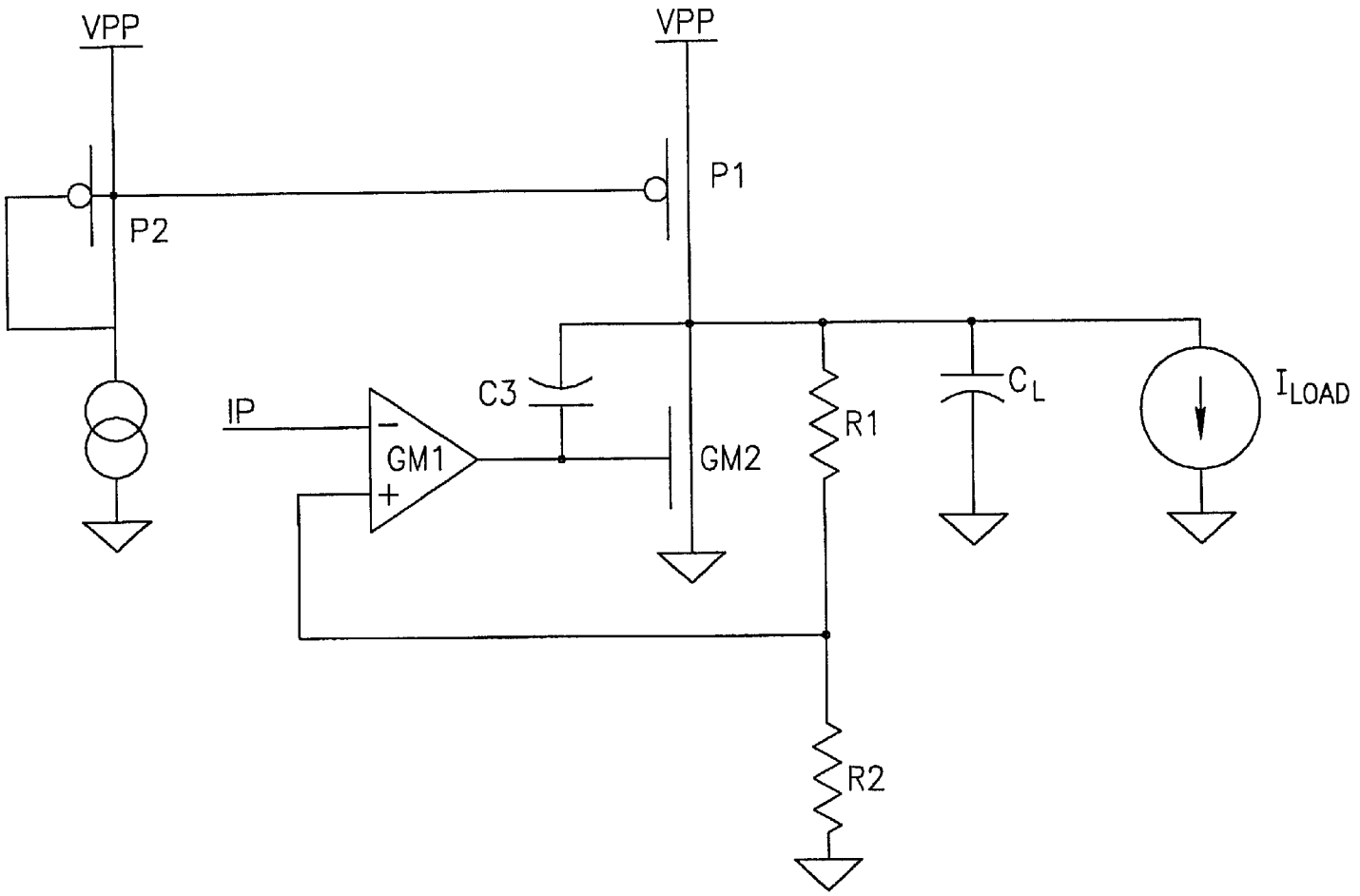
FIG.2 PRIOR ART

The output, OP, of the regulator is across a voltage divider R1-R2 connected between the drain of the current mirror output P1 and ground. There is current flow from VPP through P1 and the divider R1-R2 to ground. R1 is connected between OP and FB, the feedback supply point. R2 is connected between FB and ground. As in the circuits of FIGS. 1 and 2, there is a load capacitor CL connected to ground. There is a feedback connection FB from the junction of R1-R2 to the non-inverted input of GM1. The load $I_{LOAD}$ is shown, which is the NVM memory cells. Also, the Miller capacitor Cm is shown connected between OP and the gate of P3.

The circuit described up to this point is a 2-stage operational amplifier with the two gain stages GM1 and GM2 having two high impedance nodes, n1 and OP. The nodes n1 and OP have high impedance because they are connected only to drains of transistors in saturation, or gates or capacitors, or large resistors. All of these elements have high impedance.

The stabilization of the regulator is accomplished by the Miller capacitor Cm between the high-impedance nodes n1 and OP. In the circuit of FIG. 3 the two high impedance nodes n1 and OP are at opposite phase because the inversion of the signal at n1 by P1. That is, the signal applied to the gate of the PMOS P1 appears inverted at its drain, which is the point OP. Because of this, the Miller capacitor provides negative feedback from OP to P3 as is required by such compensation capacitors.

The dominant pole of the circuit is defined by GM1/Cn1, where Cn1 is the total capacitance at node n1. The dominant capacitance at n1 is the Miller capacitance which is approximately $A_2$XCn1 which $A_2$ is the second stage GM2 gain.

The secondary pole is determined by the transconductance of GM2 divided by Cl, as is known by those skilled in the art. The condition for stability in a two pole operational amplifier circuit is that the secondary pole is well below the unity-gain frequency. This is accomplished by proper choice of the gain of GM1 and GM2 and the value of capacitor Cm, as is well known in the art. Specifically, the gain of GM1 should be small, the gain of GM2 should be large and Cm should position the poles such that the secondary pole is 3x the closed loop gain frequency. This is known in the art as pole-splitting.

The circuit of FIG. 3 conserves current. Firstly, GM1 operates from VDD, which is a less resource costly supply compared to the source that produces the boosted VPP. This is because the low efficiency when generating VPP. That is, the charge pump does not have to pump voltage from VDD up to the VDD level to supply it to GM1. Secondly, the feedback loop FB from the output to GM1 adjusts the current in P1 according to $I_{LOAD}$ That is, for example, as $I_{LOAD}$ increases, the feedback loop increases the current in the P3/GM2/P2 path, as well as P1, providing just enough current to drive $I_{LOAD}$ and R2-R1 to the regulated output voltage.

There can be a multiplication factor such as for example 10:1, between P1:P2 so that the middle branch (P3, GM2, P2) of the circuit does not consume significant current. When $I_{LOAD}$ is low, the feedback will adjust P1 to provide just enough current to supply the load current. Thus, current from the VPP charge pump supply is not wasted, as in the circuit shown in FIG. 1.

The circuit of FIG. 3 is also configured such that it has a high PSRR. The gate of P1, which supplies the load current from the VPP source, is strongly linked to VPP by the transconductance of P2. Thus, it has a PSRR similar to that of the circuit shown in FIG. 2. That is, the Vgs of P1 remains constant at all frequencies of VPP ripple, since both its gate and source are strongly coupled to VPP. Accordingly, the circuit of FIG. 3 has the advantages of both prior art circuits of FIGS. 1 and 2 without the disadvantages of either one.

Figure 4B:
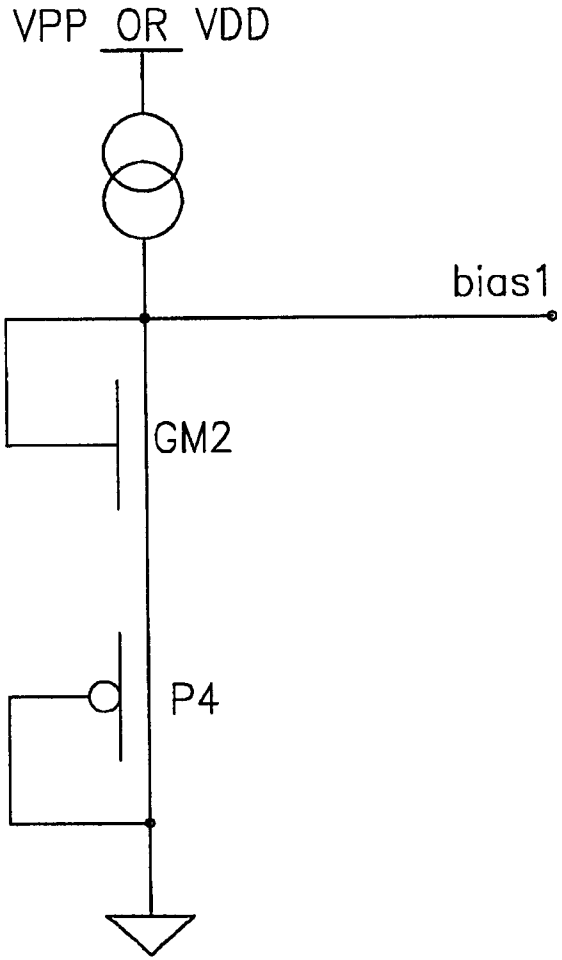
FIGS. 4A and 4B are biasing circuits for the regulator.
Figure 4A:
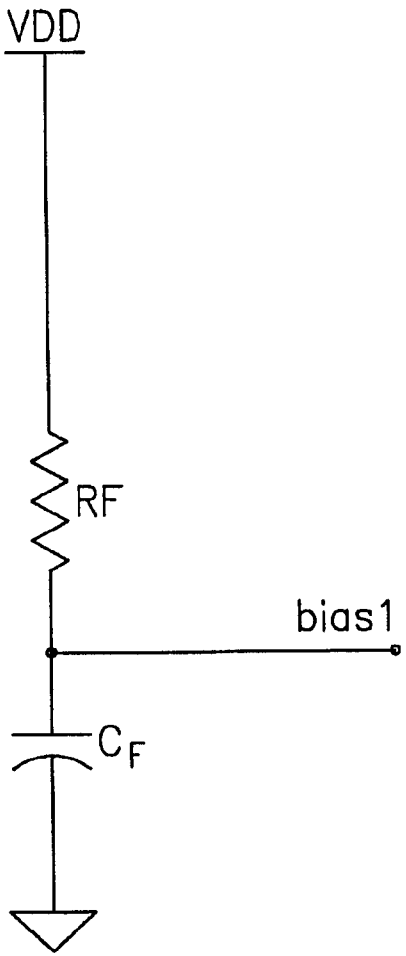

FIGS. 4A and 4B show two possible biasing sources of the bias 1 voltage for the second gain stage GM2 of FIG. 3. FIG. 4A shows a series connected resistor RF connected between VDD and bias 1 and a capacitor CF connected between bias 1 and ground. This produces a filtered VDD at the junction of RF and CF that is the bias voltage bias 1. That is, high frequency noise from VDD is filtered to ground by CF and is not amplified by GM2.

A second bias circuit is shown in FIG. 4B. Here, there is a stacked Vt circuit similar to that formed by GM2 and P3 in FIG. 3. This is a series connection of the source node of an NMOS transistor GM2 to the source node of a PMOS transistor P4. The drain and gate nodes of GM2 are connected to a current source from VPP or VDD. The drain and gate nodes of P4 are connected to ground. The bias 1 voltage is taken from the gate/drain of GM2. Here the VDD noise is rejected since bias 1 is AC-coupled to ground.

Figure 5:
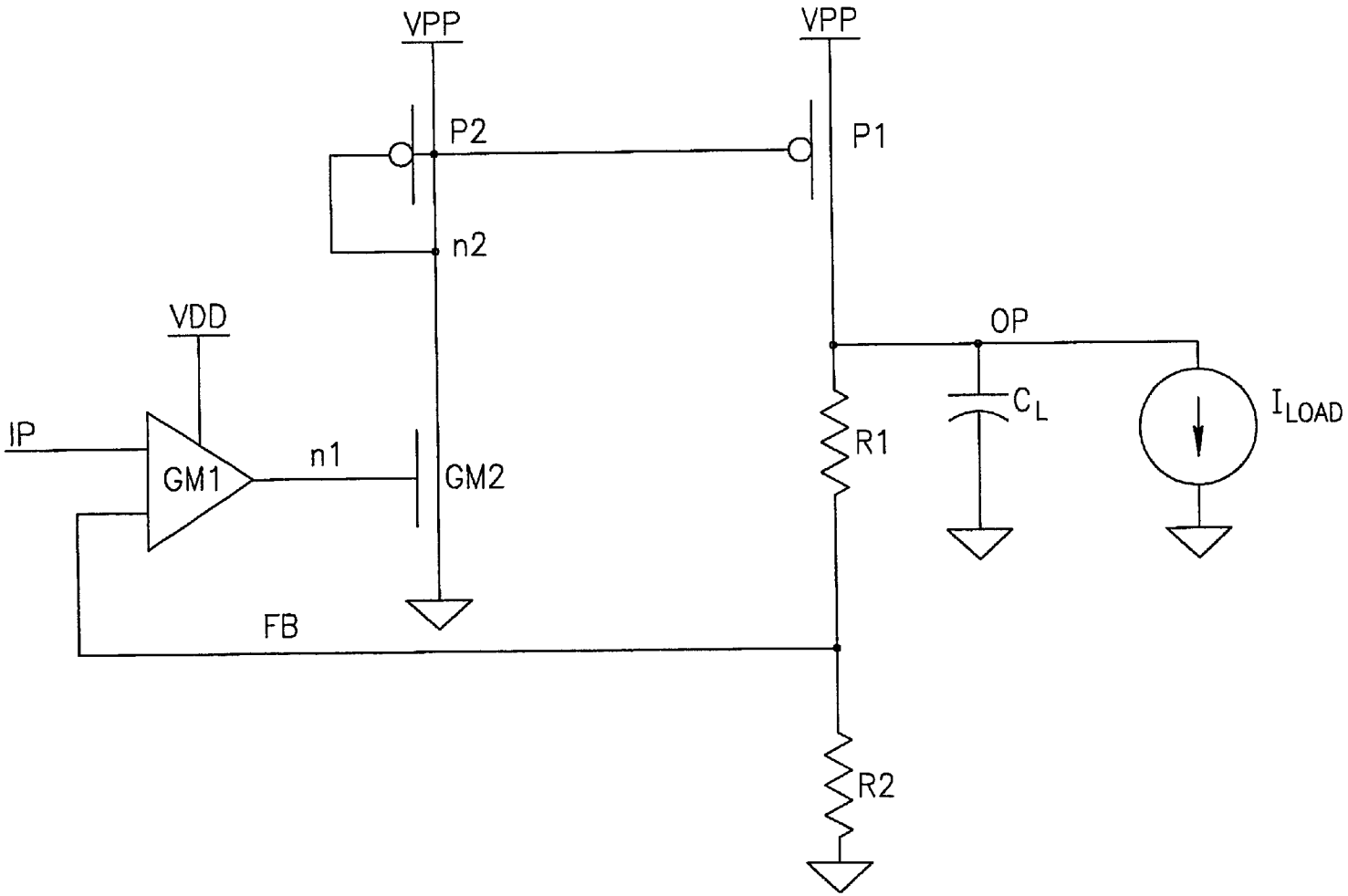
FIG. 5 is a diagram of another embodiment of the invention.

A second embodiment of the invention is shown in FIG. 5. Similar elements as in FIG. 3 have the same reference characters. Here, there is the differential amplifier GM1 having a reference voltage IP at the inverting input and a feedback input FB, described below, at the non-inverting input. The operating voltage for GM1 is from the VDD source.

The output of GM1 is connected to the gate node of a gain stage NMOS transistor GM2 whose source node is connected to ground. The drain node output of GM2 is connected to the gate and drain nodes of a current mirror input PMOS transistor P2 whose source is connected to the charge pump output voltage, VPP. The current output determined by GM2 is mirrored via P2 to the output PMOS transistor P1 of the current mirror. The PMOS transistor P1 gate node is connected to the drain node output of P2 and the source node of P1 is connected to VPP.

The drain node of P1 is connected to the output (OP) of the regulator. The output, OP, is also connected to series connected resistors R1 and R2, which form a voltage divider between OP and ground. The first terminal of R1 is connected to OP, while the second terminal of R1 is connected to FB. The first terminal of R2 is connected to FB, while its second terminal is connected to ground. FB is also connected to the non-inverting input of GM1. The output, OP, can be connected to a load, which can be capacitive or resistive, as represented in FIG. 3 by the capacitor CL and the current source attached to OP.

A capacitor CL is connected from the drain node of P1 across the voltage divide R1-R2 to ground. A feedback FB signal is provided from the junction of the voltage divider R1-R2 to the non-inverting input of GM1.

As seen, the circuit of FIG. 5 differs from FIG. 3 in that Cm is omitted. Also, P3 is omitted and the output of the differential amplifier GM1 is fed directly to the gate of gain stage transistor GM2. Because of the absence of P3, the two high impedance nodes n1 and OP are in phase with each other, so it is not possible to use Miller capacitor compensation. The amplifier GM1 can be stabilized by placing a very large value capacitor (not shown) at the output OP. In this manner, the dominant pole of the system becomes the one associated with OP, while the secondary pole is GM1/Cn1. It is important that the transconductance of GM1 be very large, and that the transconductance of GM2 and Cn1 be small, so that the secondary pole will be below the unity gain frequency.

The circuit of FIG. 5 exhibits similar PSRR and VPP current consumption as the circuit shown in FIG. 3. The advantage of this embodiment is that it has a faster response time because of the large transconductance of GM1 and lower capacitance at n1. The disadvantage is that this embodiment requires a very large output capacitor to maintain stability and may be somewhat unstable at high $I_{LOAD}$ values because this will cause the transconductance of GM2 to increase.

It is understood that MOSFETs are symmetrical devices with respect to the source and drain and thus for purposes of the invention the designation of source and drain should be considered in the broadest sense.

Specific features of the invention are shown in one or more of the drawings for convenience only, as each feature may be combined with other features in accordance with the invention. Alternative embodiments will be recognized by those skilled in the art and are intended to be included within the scope of the claims.

We claim:

1. A voltage regulator to drive a variable current source, comprising:

a source of a first voltage and a source of a second voltage at a higher level than said first voltage;

a differential amplifier operating from said first voltage and having two inputs and an output with a reference voltage applied to one of said two inputs;

a gain stage having an input and an output with the input connected to the output of said differential amplifier;

a current mirror comprising an input stage and a mirrored output stage connected to said input stage with both stages operating from said second voltage, the output of said gain stage being connected to the input stage of said current mirror and the current of the output stage of said current mirror being the output of the voltage regulator;

a voltage divider of two resistors connected in series having one end connected to the output stage of said current mirror and the other end connected to a point of reference potential, the voltage output point of the regulator being at the upper end of the voltage divider regulator; and a connection between the junction of the two resistors of said voltage divider and the other input of said differential amplifier to supply a feedback voltage to said differential amplifier.

2. A voltage regulator as in claim 1 wherein said gain stage comprises two transistors each having first, second and third terminals, wherein the first transistor is a source follower and the second transistor is a gain stage, said first transistor having its first terminal connected to the output of said differential amplifier, its third terminal connected to said point of reference potential and its second terminal connected to the second terminal of said second transistor, and said second transistor having its first terminal connected to a second bias voltage and its third terminal being the output of said gain stage.

3. A voltage regulator as in claim 2 wherein said gain stage first transistor is a PMOS and said second transistor is an NMOS, and wherein the first, second, third terminals of both transistors are the gate, source and drain nodes, respectively.

4. A voltage regulator as in claim 2 further comprising a biasing voltage circuit to supply said second bias voltage to said first terminal of said gain stage second transistor.

5. A voltage regulator as in claim 4 wherein said biasing voltage circuit comprises a filter circuit of a resistor and capacitor connected in series between said first voltage and said point of reference potential with the biasing voltage taken from the junction of said resistor and said capacitor which is connected to said first terminal of said gain stage second transistor.

6. A voltage regulator as in claim 4 wherein said biasing voltage circuit comprises a first NMOS transistor, a second PMOS transistor and a bleeder element having two terminals, and wherein:

said PMOS transistor having its gate and drain nodes connected to said point of reference potential and the source node of said PMOS transistor is connected to the source node of said NMOS transistor, the gate and drain nodes of said NMOS transistor are connected to each other and to the first terminal of said bleeder element, the second terminal of the bleeder element is connected to said first or second voltage, and the biasing voltage is taken from the connected gate/drain nodes of said NMOS transistor and is connected to the gate node of said second gain stage transistor.

7. A voltage regulator as in claim 2 wherein said current mirror circuit, said input and output stage comprises first and second transistors and said input and output stages and each having first, second and third terminals, said first transistor being the current mirror input stage and having its first and third terminals connected to the output of said gain stage and its second terminal connected to the second voltage and to the first terminal of said second transistor, said second transistor being the current mirror output stage and having its third terminal connected to the upper end of said voltage divider and its second terminal to the second voltage.

8. A voltage regulator as in claim 7 wherein each of said current mirror circuit first and second transistors are of the PMOS type with said first, second and third terminals respectively being the gate, drain and source nodes.

9. A voltage regulator as in claim 2 further comprising a capacitor connected between the upper end of said voltage divider and the output of said source follower.

10. A voltage regulator as in claim 1 wherein said gain stage is a transistor having a first terminal connected to the output of said differential amplifier, a second terminal connected to said point of reference potential and a third terminal connected to the input of said current mirror.

11. A voltage regulator as in claim 10 wherein said gain stage is a NMOS transistor and said first, second and third terminals are respectively the gate, source and drain of the transistor.

12. A voltage regulator as in claim 10 wherein said current mirror circuit, said input and output stage comprise first and second transistors and said input and output stages and each having first, second and third terminals, said first transistor being the current mirror input stage having its first and third terminals connected to the output of said gain stage and its second terminal connected to the second voltage and to the first terminal of said second transistor, said second transistor being the current mirror output stage and having its third terminal connected to the upper end of said voltage divider and its second terminal to the second voltage.

13. A voltage regulator as in claim 12 wherein each of said current mirror circuit first and second transistors are of the PMOS type with said first, second and third terminals respectively being the gate, drain and source.

* * * * *

UNITED STATES PATENT AND TRADEMARK OFFICE

CERTIFICATE OF CORRECTION

PATENT NO. : 6,448,750 B1
DATED : September 10, 2002
INVENTOR(S) : Shor, Joseph S. et al.

It is certified that error appears in the above-identified patent and that said Letters Patent is hereby corrected as shown below:

Title page,
Item [56], References Cited, U.S. PATENT DOCUMENTS, "6,064,251" reference, inventors name shoud read -- Park --
"6,107,862" reference, should read -- 6,107,862 8/2000 Mukainakano et al. --

Signed and Sealed this

Twenty-ninth Day of June, 2004

JON W. DUDAS
*Acting Director of the United States Patent and Trademark Office*